US006243951B1

(12) United States Patent
Oldroyd

(10) Patent No.: US 6,243,951 B1
(45) Date of Patent: Jun. 12, 2001

(54) SAFETY RAZORS

(75) Inventor: Brian Oldroyd, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/363,344

(22) Filed: Jul. 29, 1999

Related U.S. Application Data

(63) Continuation of application No. PCT/US98/02675, filed on Feb. 13, 1998.

(30) Foreign Application Priority Data

Feb. 18, 1997 (GB) ..... 9703293

(51) Int. Cl.[7] ..... B26B 21/22
(52) U.S. Cl. ..... 30/34.2; 30/50; 30/77
(58) Field of Search ..... 30/34.05, 34.2, 30/41, 47, 50, 51, 77, 78, 79, 81, 82, 74.1, 75

(56) References Cited

U.S. PATENT DOCUMENTS

| | | | |
|---|---|---|---|
| 954,871 | 4/1910 | Molkenthin . | |
| 1,075,606 | 10/1913 | Sipes . | |
| 1,079,095 | 11/1913 | Beard . | |
| 1,079,984 | 12/1913 | Henry . | |
| 1,117,262 | 11/1914 | Sherman . | |
| 1,330,030 | 2/1920 | Parker . | |
| 1,768,307 | 6/1930 | Bleloch . | |
| 3,004,337 | 10/1961 | Schweizer | 30/58 |
| 3,735,486 | 5/1973 | Risher | 30/78 |
| 3,797,110 | 3/1974 | Michelson | 30/82 |
| 4,063,354 | 12/1977 | Oldroyd | 30/47 |
| 4,184,246 | 1/1980 | Trotta | 30/47 |
| 4,272,885 | 6/1981 | Ferraro | 30/47 |
| 4,335,508 | 6/1982 | Francis | 30/32 |
| 4,378,633 | 4/1983 | Jacobson | 30/47 |
| 4,378,634 | 4/1983 | Jacobson | 30/47 |
| 4,586,255 | 5/1986 | Jacobson | 30/32 |
| 5,224,267 * | 7/1993 | Simms et al. | 30/77 |
| 5,359,774 | 11/1994 | Althaus | 30/50 |
| 5,426,851 * | 6/1995 | Gilder et al. | 30/34.2 |
| 5,475,923 | 12/1995 | Ferraro | 30/41 |
| 5,802,721 * | 9/1998 | Wain et al. | 30/82 |
| 6,009,624 * | 1/2000 | Apprille, Jr. et al. | 30/50 |

FOREIGN PATENT DOCUMENTS

| | | | |
|---|---|---|---|
| 0 477 132 A1 | 8/1991 | (EP) . | |
| 0477132 | 3/1992 | (EP) . | |
| 430030 | 12/1933 | (GB) . | |
| 1443594 * | 4/1976 | (GB) | 30/47 |

OTHER PUBLICATIONS

PCT International Search Report, in corresponding PCT/US98/02675, mailed Jun. 15, 1998.

* cited by examiner

*Primary Examiner*—Hwei Siu Payer

(57) ABSTRACT

A safety razor blade unit having a plurality of blades presenting substantially parallel blade edges. The blades are disposed between a guard and a cap. The blades are independently movable and are carried by supports. At least one of the supports has spaced portions projecting forwardly of the associated blade to present skin contacting potions.

12 Claims, 9 Drawing Sheets

SAFETY RAZORS

This application is a continuation of PCT/US98/02675 Feb. 13, 1998.

This invention relates to safety razors and in particular it refers to a safety razor blade unit having at least one blade with a cutting edge which is moved across the surface of the skin being shaved by means of a handle to which the blade unit is attached. The blade unit may be mounted on the handle to enable the blade unit to be replaced by a fresh blade unit when required. Replacement blade units are also commonly referred to as cartridges. Alternatively, a blade unit may be attached permanently to the handle with the intention that the entire razor should be discarded when the blade or blades have become dulled. Razor blade units generally include guard and cap surfaces for respectively contacting the skin in front of and behind the blade(s), these surfaces serving important roles ill establishing the so-called shaving geometry, i.e. the parameters which determine the blade orientation and position relative to the skin during shaving.

There have been prior proposals to equip a safety razor with a comb-like structure for contacting the skin in front of a blade edge, which structure is in some cases arranged on or to constitute the guard surface, while other arrangements include inclusion of the comb structure in a spacer between a pair of tandem blades. The comb structures are provided with a view to achieving a balance between safety and comfort on the one hand and closeness of shave on the other hand. Examples of prior art comb structures are described in U.S. Pat. No. 3,004,337, 4,272,885 and 5,359,774, in which it is explained that improved safety and comfort come from reduced contact between the skin and blade edge.

The prior art blade units having comb structures are equipped with fixed blades and are not easily adaptable to suit blade units in which blades are mounted to be movable under forces experienced during shaving in order to vary the shaving geometry.

In accordance with the present invention there is provided a safety razor blade unit comprising a frame with guard and cap surfaces thereon, a plurality of blades with substantially parallel blade edges mounted on the frame between the guard and cap surfaces, the blades being carried on respective blade supports for independent movement within the frame for varying the shaving geometry in accordance with forces imparted on the blades during shaving, at least one of the blade supports having rigidly connected thereto elements spaced apart along the blade carried on said blade support and projecting forwardly of the blade edge, the elements having skin contacting portions for contacting the skin immediately in front of the blade and substantially tangential to the blade edge.

The blade units having comb structures according to the prior art compromise closeness in attempting to improve safety and comfort. It has been found that excellent closeness results can be achieved while still benefiting from enhanced safety and comfort, with a preferred embodiment of a safety razor blade unit according to the invention. In the preferred embodiment the forwardly projecting elements have upper surface portions which in side elevation extend rectilinearly to a point spaced from the blade edge by a distance in the range of 0.10 to 0.30 mm. The projecting elements are preferably integral with the blade support, although they can be formed on a member firmly secured to the blade support. In either case the elements can be easily and conveniently incorporated in a blade unit having blades which are movable, and the elements remain effective despite the blade movements which occur during shaving. Furthermore, the elements have skin contacting surfaces which are closely adjacent the blade edge in all cases. Due to the upper surface portions, which can be flat or arched, lying substantially in a common plane with the blade edge, the elements have a tendency to function in similar fashion to skis or runners as they slide over the skin surface thereby guiding the blade for effective contact with the skin while deterring any tendency for blade displacement in a direction longitudinally of the blade edge.

In a preferred construction the projecting elements have flat sides and the lateral edges of the upper surface portions merge smoothly with radiused or divergent flank surfaces extending to the flat sides. These features contribute to the effectiveness of the elements while ensuring comfort is maintained.

Suitably the width of the elements is in the range of 0.1 to 0.3 mm. and the width of the upper skin contacting surface portions is not greater than 0.1 mm, which avoids any tendency for the elements to flatten the hairs against the skinsurface.

The elements are preferably positioned with a pitch of less than 2 mm, e.g. in the range of 0.5 mm to 1.5, and a pitch of approximately 1.0 mm is especially appropriate.

To ensure a gentle initial contact between the elements and the skin surface they can be provided with rounded nose portions at their forward ends, these nose portions leading smoothly into the upper surface portions.

The above and other features of a preferred embodiment of the invention are described below in more detail reference being made to the accompanying drawings, in which.

Figure 1:
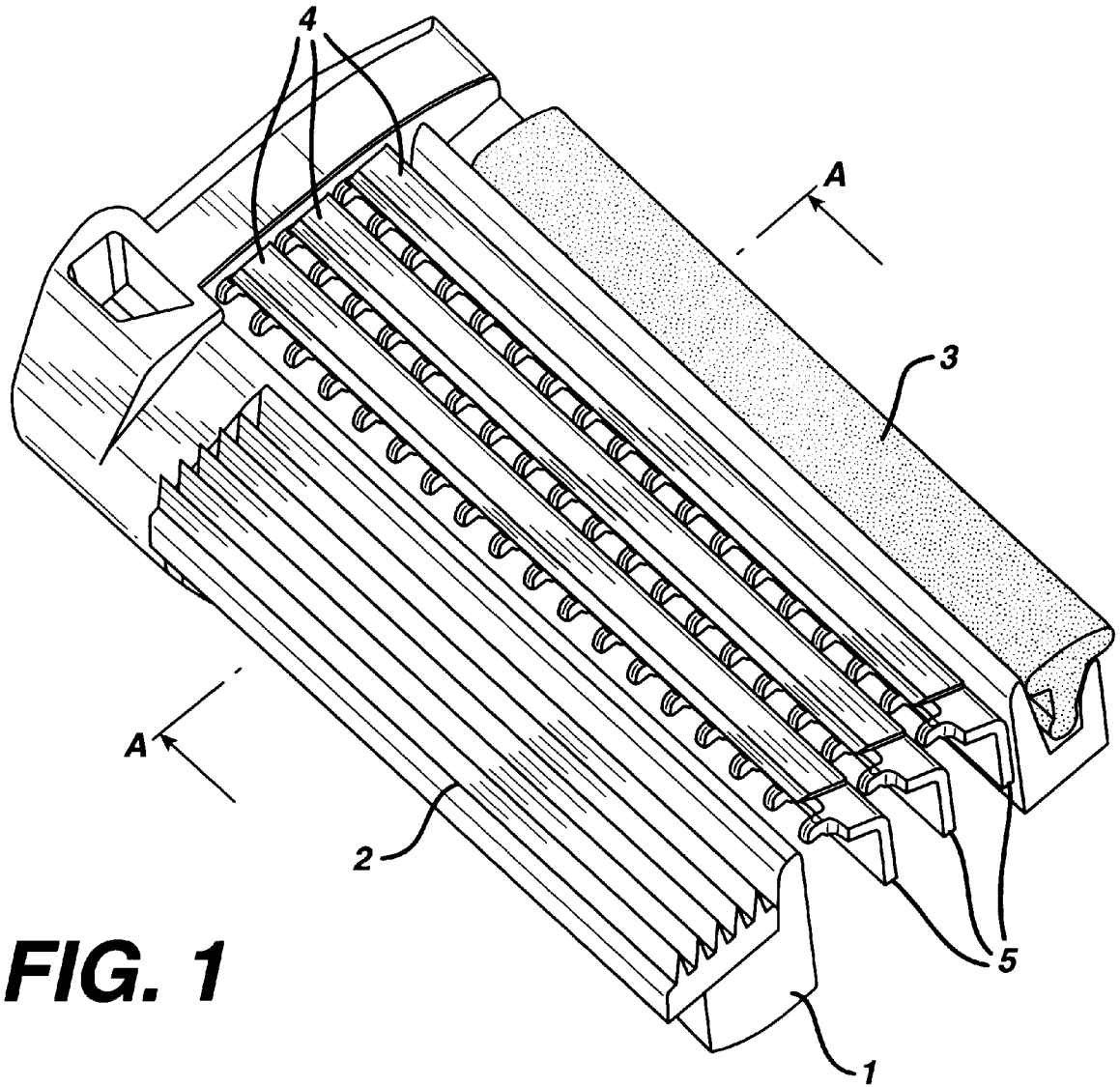
FIG. 1 is a partial perspective view of a safety razor blade unit.
Figure 1A:
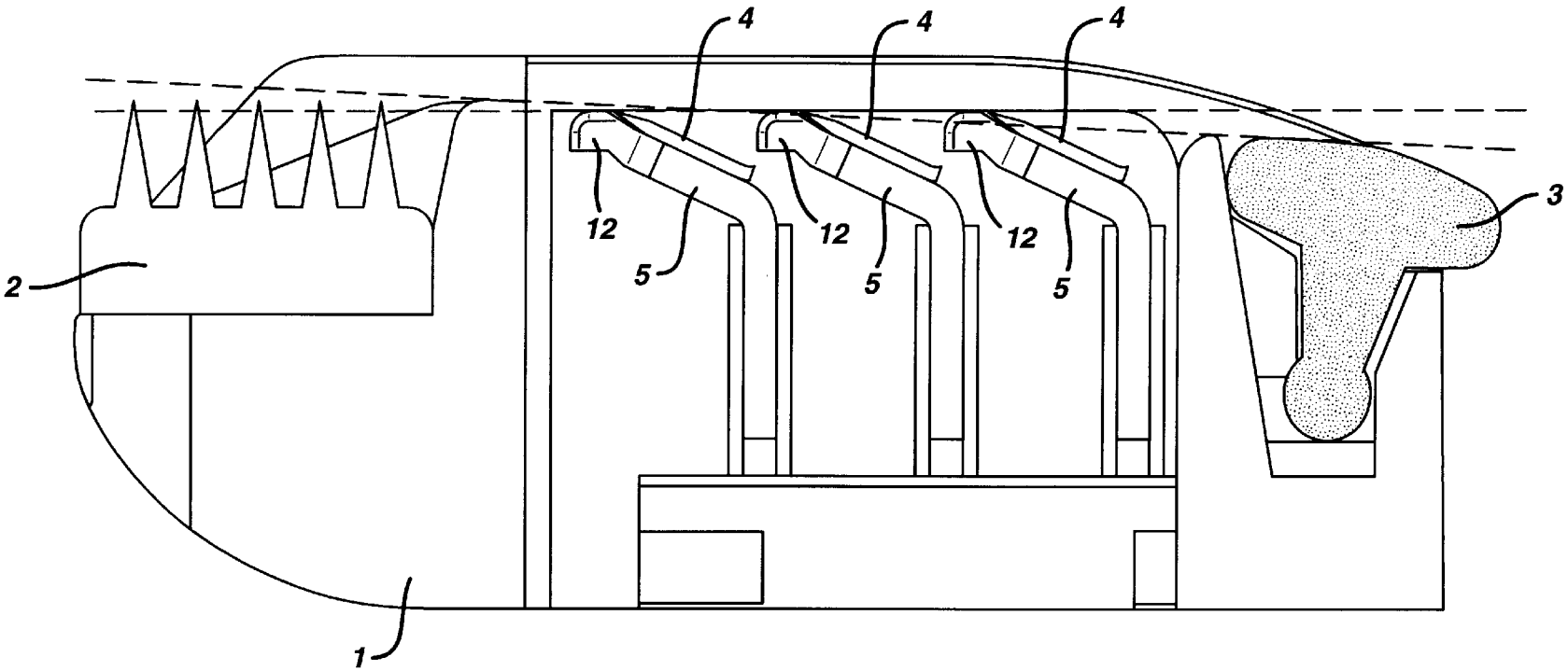

Illustrated in FIG. 1 is a safety razor blade unit or cartridge having a moulded plastics frame 1 on which guard and cap surfaces are provided and which respectively include a strip 2 of elastomeric material with longitudinal fins, and a strip 3 of lubricating material, both fixedly attached to the frame. Mounted between the guard and cap are three parallel blades 4 with forwardly directed cutting edges positioned in series between the guard and cap. Each blade 4 is fixedly connected to a blade support 5, and in a manner known per se the ends of the blade supports are connected to the frame to enable movement of the blades relative to the frame against the action of springs (not shown) and under forces imparted against the blades during shaving.

Figure 2:
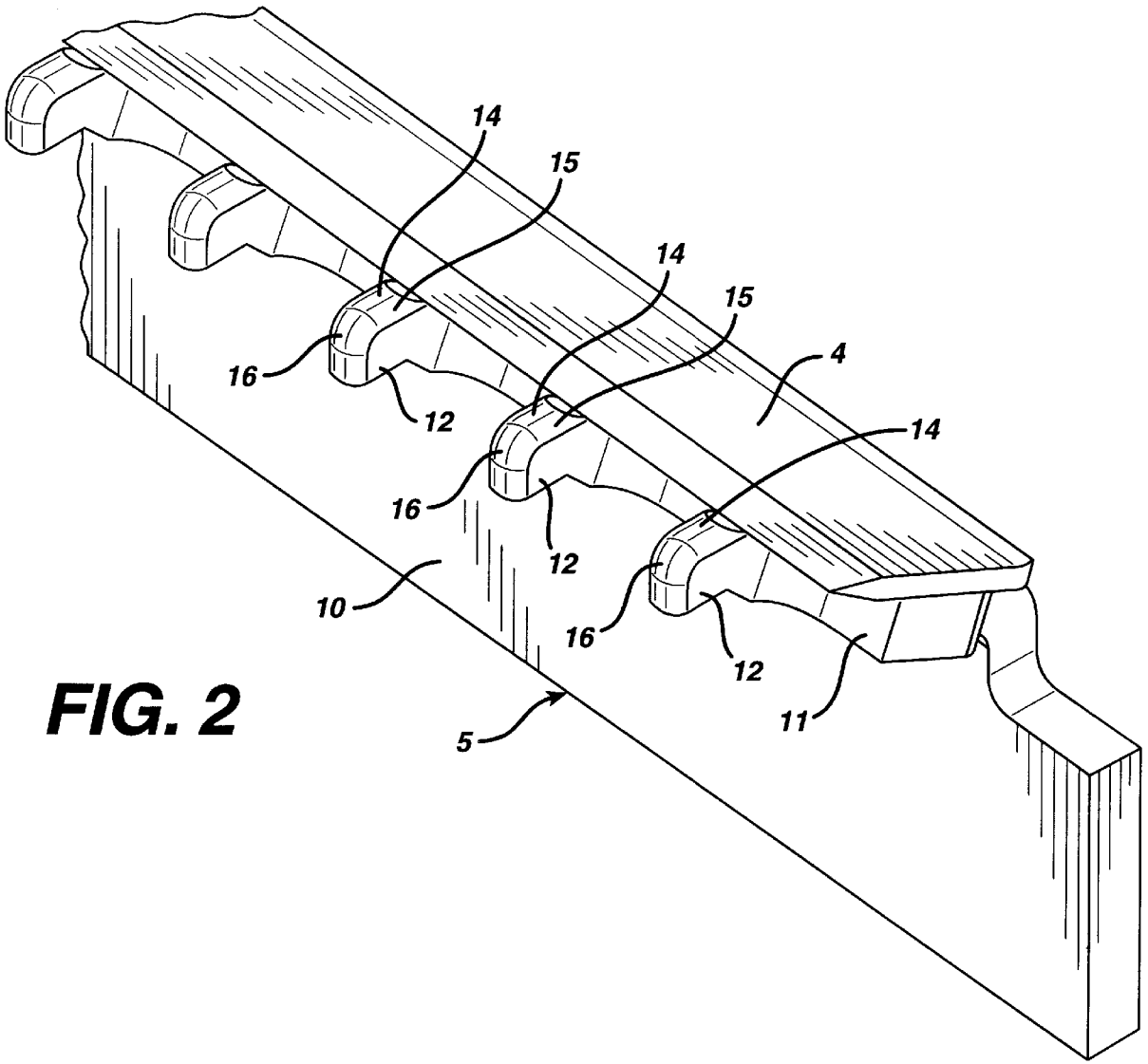
FIG. 2 is an enlarged perspective view showing part of one blade and its support.
Figure 3:
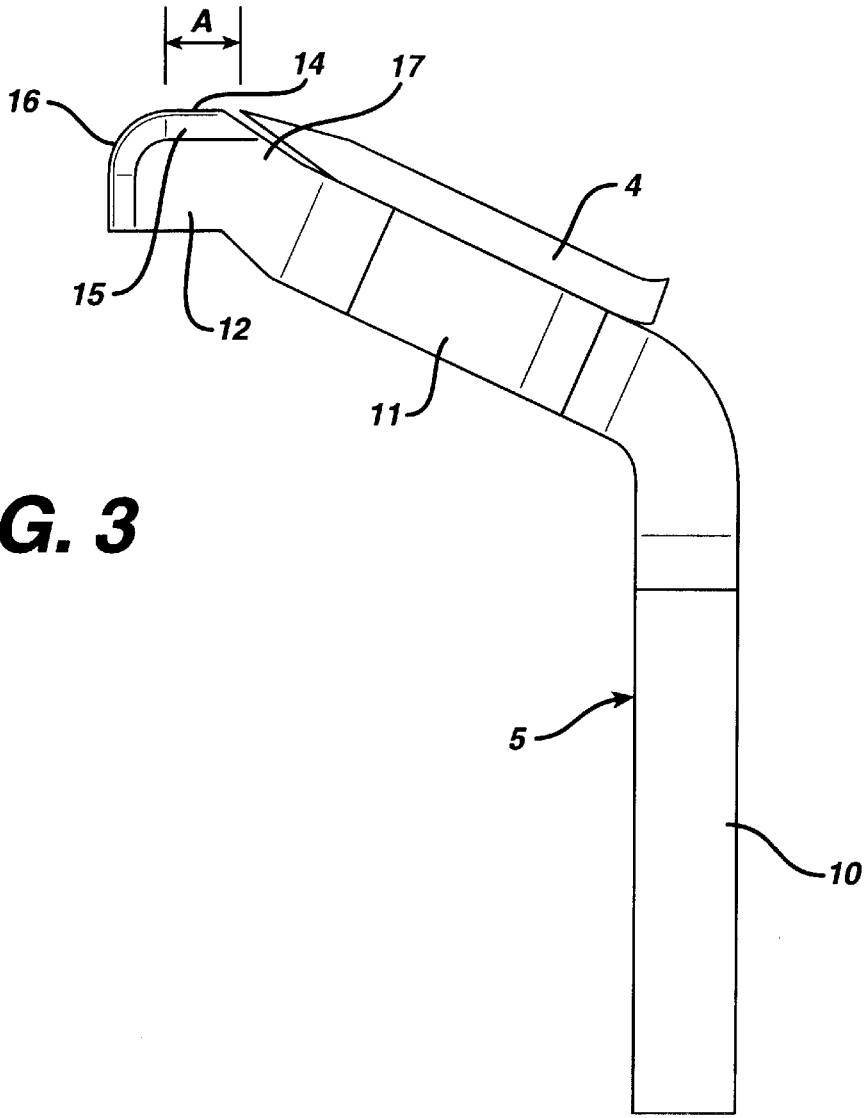
FIG. 3 is an end view of the blade and its support.
Figure 4:
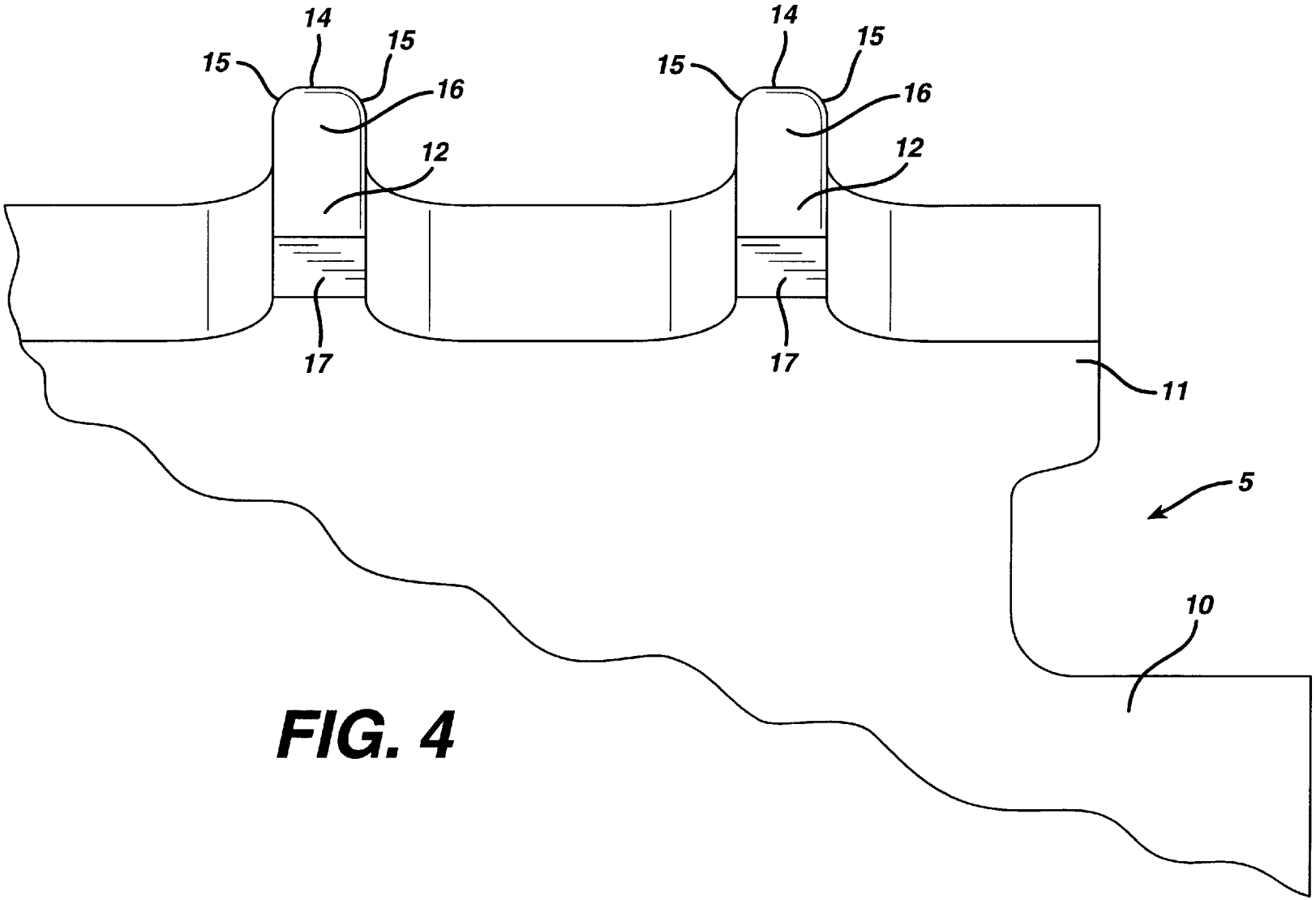
FIG. 4 is a front view of a part of the blade support.
Figure 6:
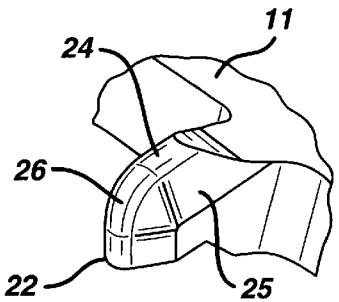
FIG. 6 is an enlarged perspective view of one of the elements of the blade support of FIG. 5.
Figure 9:
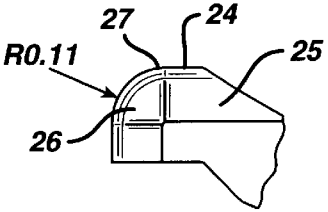
FIG. 9 is a side elevation of the element shown in FIG. 6.
Figure 5:
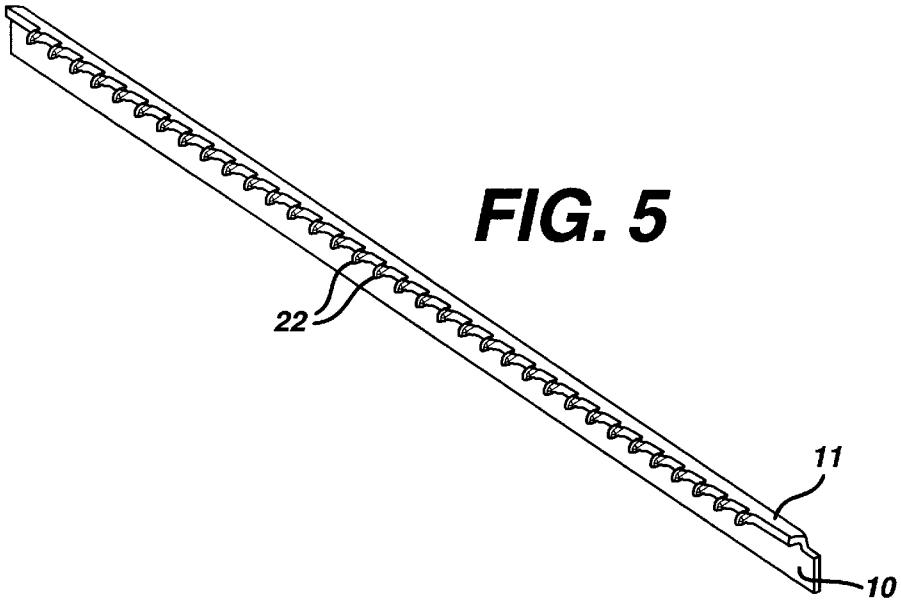
FIG. 5 shows in perspective a modified blade support.

As shown in greater detail in FIGS. 2–4, each blade support 5 includes a generally upright beam portion 10 from the upper edge of which extends a forwardly and upwardly inclined blade platform 11 against the upper surface of which the blade 4 is fixed, such as by spot welding. Uniformly spaced apart along the blade platform and projecting forwardly therefrom are integral comb elements 12 which arc perpendicular to the blade edge. The formation of the elements 12 on the blade support together with their shape, position and dimensions are the important novel features of the invention. As shown elements 12 have flat sides, at least along the sections which protrude forwardly of the blade edge and the elements have flat upper surface portions 14 which are connected to the side faces by radiused edges 15. The leading ends of the elements 12 located forwardly of the upper surface portions 14 have rounded noses 16 which lead smoothly into the surface portions 14. The root portions 17 of the elements 12 have upper surfaces which are inclined more steeply than the blade platform surface in order to follow closely the edge facet at the underside of the blade 4, although this is not essential and a larger spacing between the underside of the blade and the elements is acceptable. The rear or trailing ends of the upper surface portions 14 are closely adjacent the blade edge, the width of the gap therebetween being several times less than the distance A (FIG. 3) from the blade edge to the forward or leading ends of the surface portions 14. The surface portions 14 of all the elements on the blade support lie in a common plane which is tangential to, i.e. contains the edge of the blade carried on the support. The distance A is in the range of 0.10 to 0.3 mm, more especially from 0.15 to 0.2 mm. The width of the elements between their flat lateral faces is in the range 0.5 to 1.5 mm, for example about 1.0 mm, and the elements are positioned at a pitch of 1.0 mm.

In use the projecting elements 12 of the blade supports have a guiding effect influencing the blade unit to move over the skin in a direction perpendicular to the blade edges, the elements acting in similar manner to skis or runners sliding over the skin surface. Thereby enhanced safety and comfort can be obtained. At the same time the elements 12 ensure an effective cooperation of the blades with the skin surface leading to excellent shaving results in terms of closeness.

Figure 8:
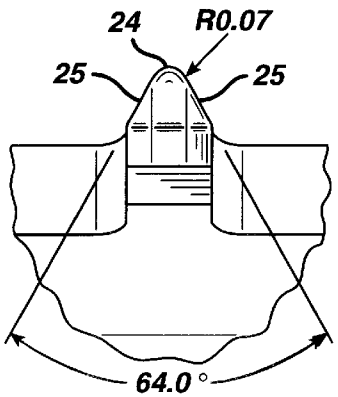
FIG. 8 is a front elevation of the element shown in FIG. 6.
Figure 7:
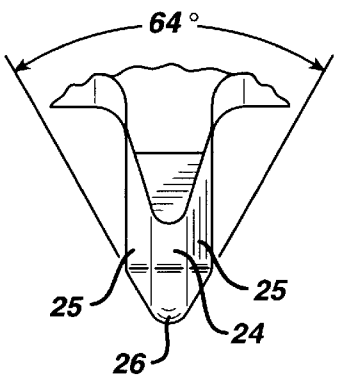
FIG. 7 is a plan view of the element shown in FIG. 6.
Figure 10:
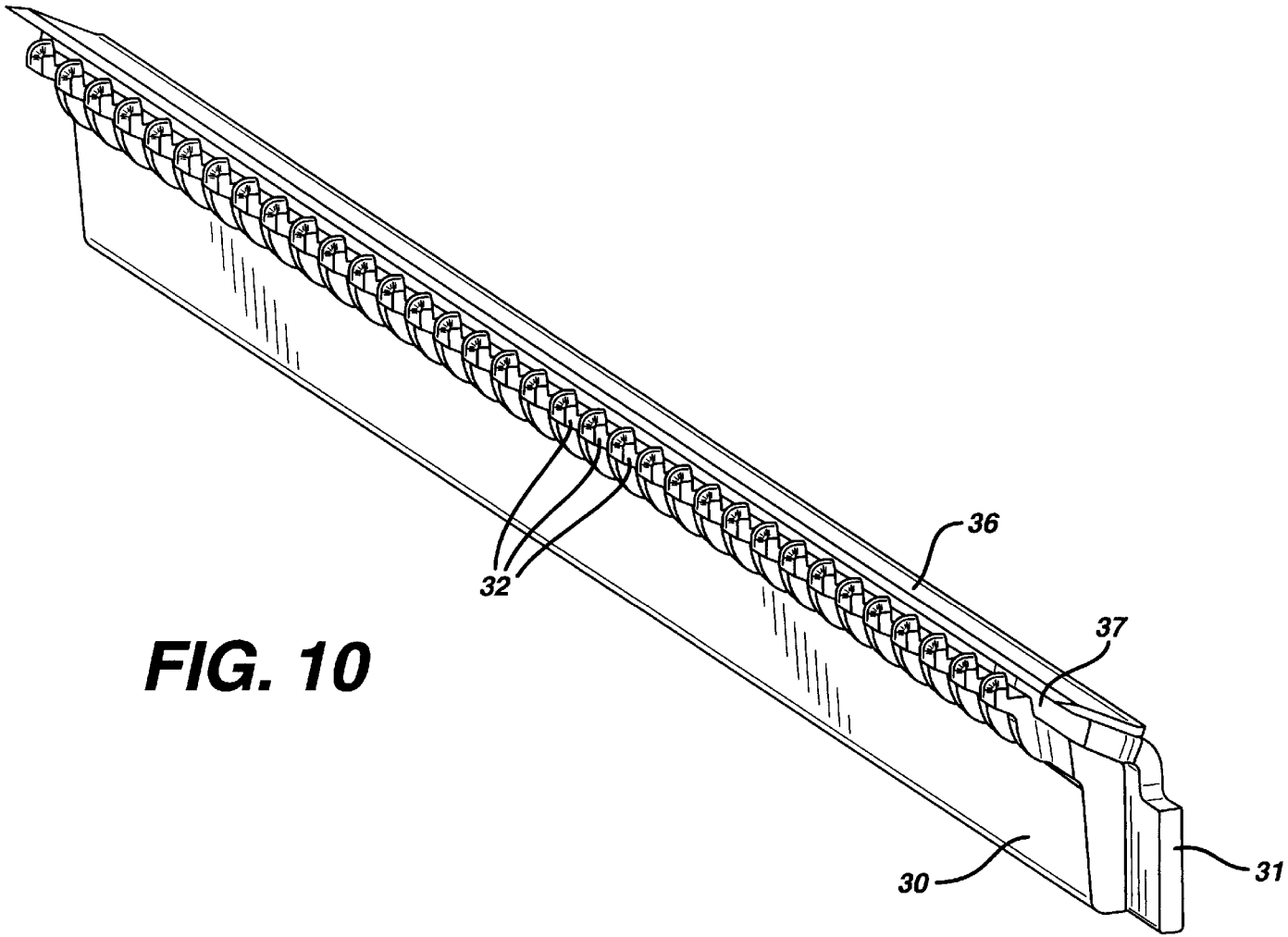
FIG. 10 shows in perspective another razor blade and support assembly.
Figure 11:
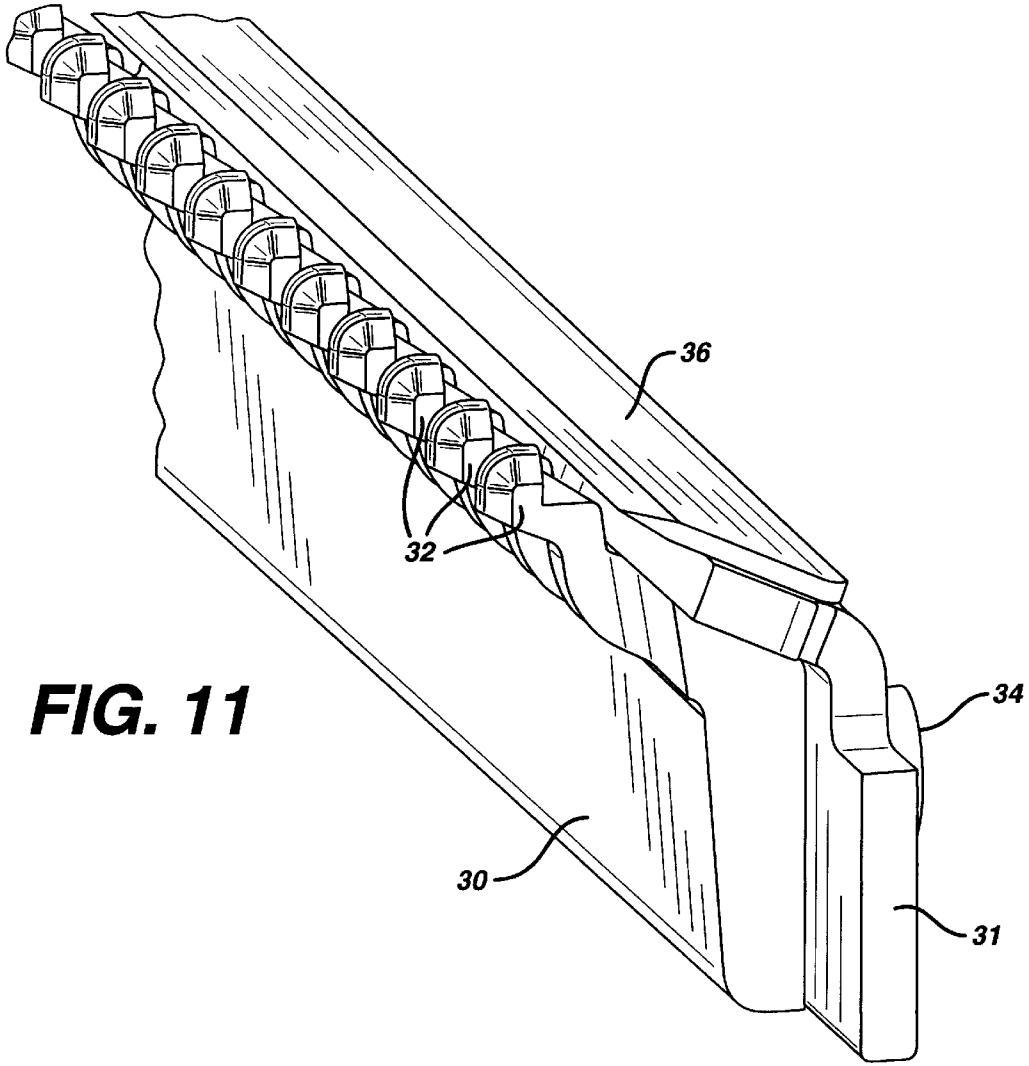
FIG. 11 is an enlarged perspective view showing part of the assembly of FIG. 10.
Figure 12:
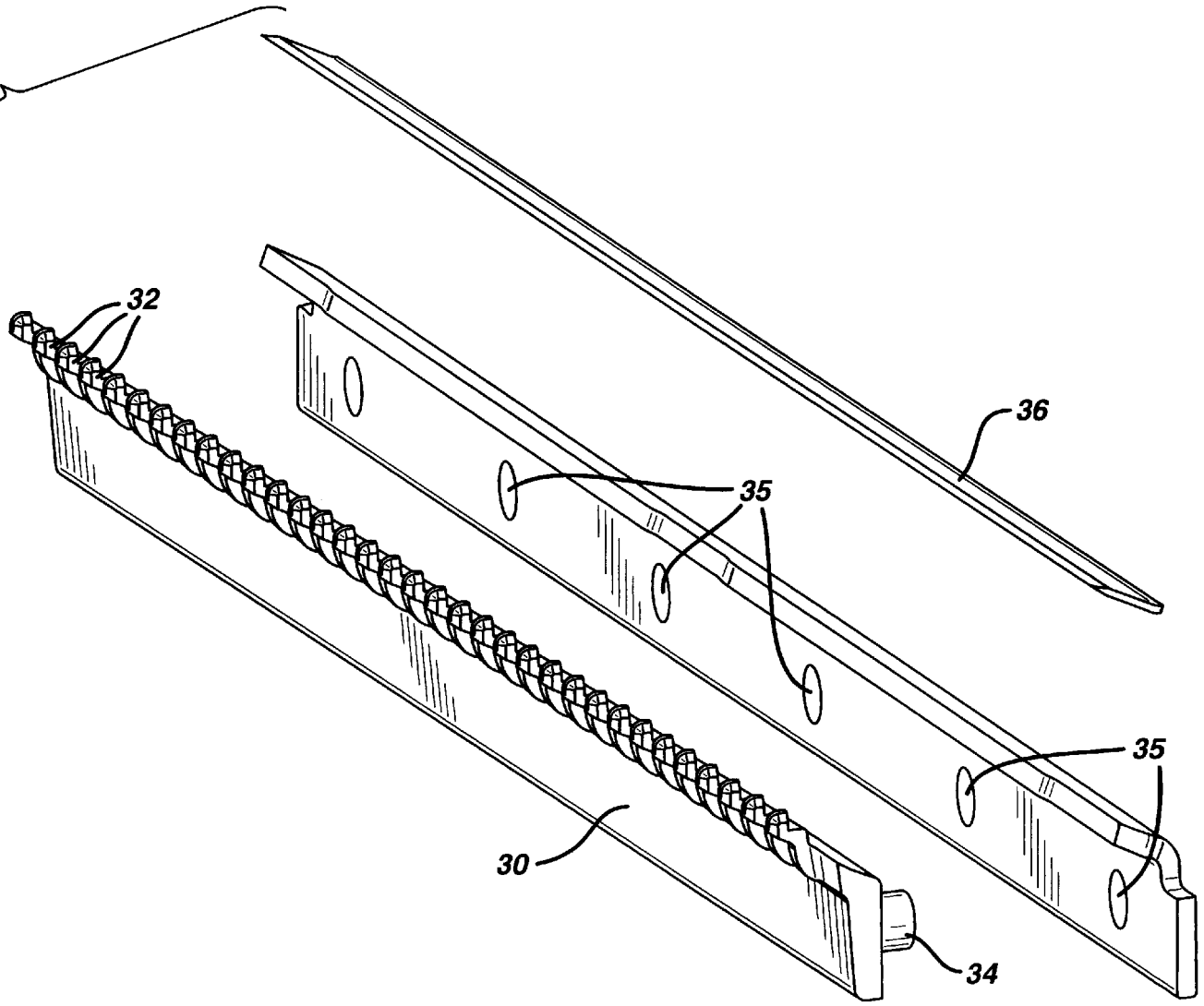
FIG. 12 is an exploded perspective view of the assembly shown in FIG. 10.

Illustrated in FIGS. 5 to 9 is a modified blade support which could be used with any one or more of the blades in the safety razor blade unit of FIG. 1. The modified blade support is the same as that described with reference to FIGS. 2 to 4, except that the shape of the forwardly projecting elements 22 is different. Instead of having flat upper surface portions, the elements have arched central upper surface portions 24 having a radius of curvature of about 0.07 mm, the lateral edges of which merge smoothly with divergent flank surfaces 25 which 10 extend to the flat side faces. As shown in FIGS. 7 & 8, the surfaces of the two flags 25 on each element 22 have, in the preferred embodiment, an included angle of about 64 degrees. As seen in side elevation (FIG. 9) the crests of the arched upper surface portions extend rectilinearly to a point 27 whereat these surface portions merge smoothly with rounded noses 26. The dimensions of the elements 22, as far as width and pitch are concerned, may be the same as described for FIGS. 2 to 4, and when a blade is mounted on the blade support. the distance of the point 27 from the blade edge will be the same as the distance A mentioned above. In FIGS. 10 to 12 there is illustrated a razor blade and blade support assembly in which instead of being integral with the blade support as in the embodiments of FIGS. 1–9, the elements 32 projecting forwardly of the blade edge are formed on a separate injection moulded plastics member 30 which is fixed securely to the blade support 31. As shown, the moulded member 30 has spaced along its length integral pegs or studs 34 which are inserted through corresponding holes 35 provided in the blade support, the protruding free ends of the studs being deformed such as by application of heat and pressure so that they are radially enlarged to the rear of the blade support and hence fasten the moulded member to the blade support. The upper edge of the moulded member is shaped to follow the contour 37 of the blade support on the underside of the portion which carries the blade 36, and the elements 32 project forwardly from this upper edge. The rear end upper faces of the member 30 define two surfaces for abutment with the blade support 31 to assist in ensuring accurate alignment of the projecting elements with the blade support and hence the cutting edge of the blade 36. The projecting elements 32 may have the same shape and dimensions as the elements 22 of the blade support described above with reference to FIGS. 5–9 and they are preferably positioned in relation to the sharpened edge of the blade 36, also as described above in relation to the earlier embodiments. The blade and support assembly of FIGS. 10–12 can be used as one or more of the blade and support assemblies in the razor blade unit of FIG. 1.

While it is apparent that modifications and changes can be made within the spirit and scope of the present invention, it is our intention, however, only to be limited by the appended claims.

What is claimed is:

1. A safety razor blade unit comprising a frame with guard and cap surfaces thereon, a plurality of blades with substantially parallel blade edges mounted on the frame between the guard and cap surfaces, the blades being carried on respective blade supports for independent movement within the frame for varying the shaving geometry in accordance with forces imparted on the blades during shaving, at least one of the blade supports having rigidly connected thereto elements spaced apart along the blade carried on said blade support and projecting forwardly of the blade edge, the elements having skin contacting portions for contacting the skin immediately in front of the blade and substantially tangential to the blade edge.

2. A safety razor blade unit according to claim 1 wherein the forwardly projecting elements are integral with the blade support.

3. A safety razor blade unit according to claim 1, wherein the elements have upper surface portions which in side elevation extend rectilinearly to a point spaced from the blade edge at a distance (A) in the range of 0.10 to 0.30 mm.

4. A safety razor blade unit according to claim 3, wherein the length of rectilinear by extending upper surface portion is several times the distance between said surface portions and the blade edge.

5. A safety razor blade unit according to claim 3 wherein at their forward ends said upper surface portions of said elements merge smoothly with rounded nose portions of the elements.

6. A safety razor blade unit according to claim 3 wherein said elements have flat sides and the lateral edges of the upper surface portions of said elements merge smoothly with radiused or divergent flank surfaces extending to the flat sides.

7. A safety razor blade unit according to claim 1 wherein the elements have a width of 0.1 to 0.3 mm.

8. A safety razor blade unit according to claim 7, wherein the width of said upper surface portions of said elements is not greater than 0.15 mm.

9. A safety razor blade unit according to claim 1 wherein the elements are positioned longitudinally of the blade at a pitch of less than 2 mm.

10. A safety razor blade unit according to claim 9, wherein the pitch of the elements longitudinally of the blade is in the range of 0.5 to 1.5 mm.

11. A safety razor blade unit according to claim 10, wherein the pitch is substantially equal to 1.0 mm.

12. A safety razor blade unit according to claim 1, wherein rearwardly of the skin contacting portions the elements have root portions with upper faces inclined to follow the blade facet on the underside of the blade.

* * * * *